US006336873B1

(12) United States Patent
Yamagishi et al.

(10) Patent No.: US 6,336,873 B1
(45) **Date of Patent: *Jan. 8, 2002**

(54) GOLF BALL

(75) Inventors: Hisashi Yamagishi; Takashi Maruko; Atsushi Nakamura, all of Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/487,774

(22) Filed: Jan. 20, 2000

(30) Foreign Application Priority Data

Feb. 5, 1999 (JP) ..... 11-028769

(51) Int. Cl.[7] ..... A63B 37/12
(52) U.S. Cl. ..... 473/378; 473/377
(58) Field of Search ..... 473/378–384

(56) References Cited

U.S. PATENT DOCUMENTS 5,601,503 A * 2/1997 Yamagishi et al. ..... 473/384
5,702,312 A * 12/1997 Horiuchi et al. ..... 473/377
5,800,287 A * 9/1998 Yokota et al. ..... 473/372

FOREIGN PATENT DOCUMENTS

JP 7-24084 1/1995 ..... A63B/37/00
JP 7-24085 1/1995 ..... A63B/37/00
JP 9-239067 9/1997 ..... A63B/37/00
JP 9-239068 9/1997 ..... A63B/37/00
JP 10-151225 6/1998 ..... A63B/37/00
JP 10-248955 9/1998 ..... A63B/37/00

* cited by examiner

*Primary Examiner*—Mark S. Graham
*Assistant Examiner*—Raeann Gorden
(74) *Attorney, Agent, or Firm*—Sughrue Mion, PLLC

(57) ABSTRACT

In a golf ball comprising a core and a cover of at least two layers around the core, the cover layers including the outermost layer which is formed with a plurality of dimples, the core undergoes a deflection of 3.0–6.0 mm under a load of 100 kg, the cover outermost layer has a Shore D hardness of 58–70, and the product of the Shore D hardness of the cover outermost layer multiplied by the Shore D hardness of a cover layer disposed inside the cover outermost layer is 1,500–5,000. The plurality of dimples include at least three types of dimples which are different in diameter and/or depth, and the ratio of average diameter to average depth of the dimples is from 27/1 to 33/1. The overall dimple volume is 260–340 $mm^3$. The ball has an improved overall profile of performance including feel, durability, rebound and flight characteristics.

18 Claims, 1 Drawing Sheet

GOLF BALL

This invention relates to a golf ball comprising a core and a cover of at least two inner and outer layers and more particularly, to a golf ball of such structure having an improved overall profile of performance including feel, durability, rebound and flight characteristics.

BACKGROUND OF THE INVENTION

Many golf balls having different multilayer structures are known, for example, from JP-A 7-24084, 7-24085, 9-239067, and 9-239068. By tailoring their structure, these balls are improved in feel, durability and rebound.

JP-A 10-248955 discloses a two-piece solid golf ball comprising a solid core and a cover which is formed with a plurality of dimples in its surface. The plurality of dimples include at least three types of dimples which are different in diameter. The diameter (mm) divided by the depth (mm) of each dimple ranges from 18 to 27. The volume of each dimple divided by the volume of a cylinder whose diameter and height are equal to the diameter and depth of the dimple ranges from 0.390 to 0.550.

JP-A 10-151225 discloses a three-piece solid golf ball in which improvements in spin performance, feel and control with any type of club are attained by paying attention to the relationship of inertia moment to the ball structure and dimples. The ball has a high inertia moment, and the diameter/depth ratio of dimples is as low as about 17/1.

Since these proposals intend to improve the feel, durability and rebound of balls primarily by tailoring the ball structure, they fail to take full advantage of the spin performance and dimple characteristics having a significant influence on the flight following shots. There is left a room for further improvement.

The prior art golf balls do not fully meet the demand of users that the balls satisfy the feel, rebound, durability and approach control requirements imposed on the ball structure and offer good flight performance following shots, and thus have an advanced overall profile of performance.

SUMMARY OF THE INVENTION

An object of the invention is to provide an improved golf ball having an advanced overall profile of performance including a good feel, durability, rebound and flight performance.

The invention is directed to a golf ball comprising a core and a cover of at least two layers around the core, the cover layers including the outermost layer which is formed with a plurality of dimples. It is understood that where the cover consists of two inner and outer layers, the outermost layer is simply referred to as the outer layer. In the case of a golf ball having a cover consisting of two inner and outer layers, for example, it has been found that (1) spin is correlated to the hardnesses of the cover inner and outer layers such that the ball receives more spin when the cover inner or outer layer is soft, and the ball is less susceptible to spin when both the cover inner and outer layers are hard; and that (2) when the product of the Shore D hardness of the cover inner layer multiplied by the Shore D hardness of the cover outer layer is large, setting the overall dimple volume relatively small is effective for increasing distance, and when the hardness product is small, setting the overall dimple volume relatively large is effective for increasing distance.

The invention provides a golf ball comprising a core and a cover of at least two layers around the core, the cover layers including the outermost layer which is formed with a plurality of dimples. The core has a hardness corresponding to a deflection of 3.0 to 6.0 mm under a load of 100 kg. The cover outermost layer has a Shore D hardness of 58 to 70. The product (A×B) of the Shore D hardness, represented by B, of the cover outermost layer multiplied by the Shore D hardness, represented by A, of a cover layer disposed inside and contiguous to the cover outermost layer is in the range of 1,500 to 5,000. It is understood that in the case of a cover consisting of inner and outer layers, the inside layer is the inner layer and in the case of a cover consisting of innermost, inner and outer layers, the inside layer is the inner layer. The plurality of dimples include at least three types of dimples which are different in diameter or depth or both and have an average diameter (AD) and an average depth (AP) wherein the ratio (AD/AP) of the average diameter to the average depth is from 27/1 to 33/1. The overall dimple volume which is the sum of the volumes of all dimple spaces each defined below a plane circumscribed by a dimple edge is in the range of 260 to 340 $mm^3$. Upon full shots with a driver, the ball receives a less spin, travels along a boring trajectory, and thus covers a long distance. The ball satisfies the feel, durability and rebound (or restitution) requirements imposed on the ball structure and thus has an advanced overall profile of performance over the prior art.

In preferred embodiments, the core is formed of a rubber composition based on cis-1,4-polybutadiene; the golf ball has a hardness corresponding to a deflection of 2.3 to 4.0 mm under a load of 100 kg; and the total number of dimples is 370 to 450.

DESCRIPTION OF THE PREFERRED EMBODIMENTS

Figure 1:
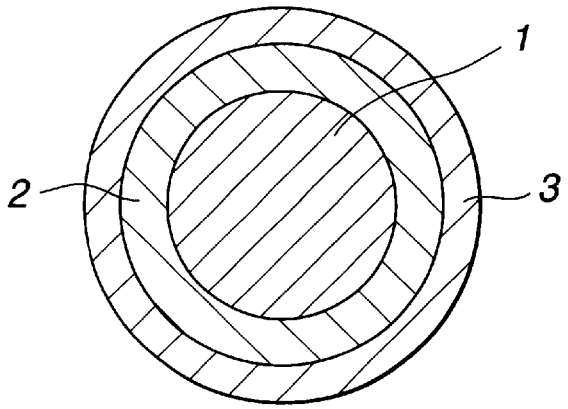
FIG. 1 is a schematic cross-sectional view of a golf ball according to one embodiment of the invention.

Referring to FIG. 1, a golf ball according to one embodiment of the invention is illustrated as comprising a core 1 and a cover around the core 1. The cover in this embodiment includes a cover inner layer 2 enclosing the core 1 and a cover outer layer 3 enclosing the inner layer 2. These layers are concentric with the core. The cover outer layer 3 is formed with a plurality of dimples (not shown) in its surface. In another embodiment, the cover is of three-layer structure including innermost, inner and outer layers.

The core is formed of a rubber composition comprising polybutadiene as a base rubber. The polybutadiene used herein is preferably cis-1,4-polybutadiene containing at least 40% of cis structure. In the base rubber, another rubber component such as natural rubber, polyisoprene rubber or styrene-butadiene rubber may be blended with the polybutadiene if desired. Since resilience is improved by increasing the content of polybutadiene, the rubber component other than polybutadiene should preferably be less than about 10 parts by weight per 100 parts by weight of polybutadiene.

In the rubber composition, a crosslinking agent may be blended with the rubber component. Exemplary crosslinking agents are zinc and magnesium salts of unsaturated fatty acids such as zinc dimethacrylate and zinc diacrylate, and esters such as trimethylpropane methacrylate. Of these, zinc diacrylate is preferred because it can impart high resilience. The crosslinking agent is preferably used in an amount of about 15 to 40 parts by weight per 100 parts by weight of the base rubber. Also a vulcanizing agent is generally blended in the rubber composition. Exemplary vulcanizing agents are dicumyl peroxide and mixtures of dicumyl peroxide and 1,1-bis(t-butylperoxy)-3,3,5-trimethylcyclohexane. The vulcanizing agent is preferably used in an amount of about 0.1 to 5 parts by weight per 100 parts by weight of the base rubber.

In the rubber composition, antioxidants and specific gravity adjusting fillers such as zinc oxide and barium sulfate may be blended. The amount of such fillers blended is preferably 0 to about 130 parts by weight per 100 parts by weight of the base rubber.

The rubber composition is obtained by kneading the above-mentioned components in a conventional mixer such as a kneader, Banbury mixer or roll mill. The resulting compound is molded in a mold by injection or compression molding.

The core is preferably formed to a diameter of 25 to 40 mm, more preferably 27 to 39 mm and a weight of 10 to 40 g, more preferably 15 to 35 g.

The core should have a hardness corresponding to a deflection of 3.0 to 6.0 mm under an applied load of 100 kg, preferably 3.0 to 5.5 mm, and more preferably 3.0 to 5.0 mm under a load of 100 kg. A deflection of less than 3.0 mm indicates a hard core, leading to a poor feel when hit. A deflection of more than 6.0 mm indicates a soft core, leading to a ball with less resilience.

The core is usually formed to a single layer structure from one material although it may also be formed to a two or multi-layer structure from different materials if desired.

According to the invention, the core is enclosed with a cover of at least two inner and outer layers, preferably two or three layers. In the illustrated embodiment of FIG. 1, the cover consists of inner and outer layers 2 and 3, which are successively formed around the core 1. In the following description, reference is primarily made to the illustrated embodiment of FIG. 1. The cover inner and outer layers are generally formed of cover stocks based on thermoplastic resins. Useful thermoplastic resins are ionomer resins, polyester elastomers, polyamide elastomers, polystyrene elastomers, polyurethane elastomers, polyolefin elastomers, and mixtures thereof. The ionomer resins are especially preferable and commercially available, for example, under the trade name of Himilan from Dupont-Mitsui Polychemical K.K. and Surlyn from E. I. duPont. If necessary, UV absorbers, antioxidants, and dispersants such as metal soaps may be added to the cover stocks. Similar cover stocks may be used when the cover is of three-layer structure.

According to the invention, the outermost layer (or outer layer in FIG. 1) of the cover has a Shore D hardness of 58 to 70, preferably 58 to 65, and more preferably 58 to 63. The cover outer layer with a too low Shore D hardness provides too much spin whereas the outer layer with a too high Shore D hardness provides too less spin, both failing to achieve optimum cooperation with the dimples. The cover inner layer preferably has a Shore D hardness of 30 to 70, more preferably 35 to 68, and most preferably 40 to 64.

The cover inner and outer layers may be equal or different in Shore D hardness. Differently stated, either of the inner and outer layers may be softer than the other. The hardness difference between the inner and outer layers is selected as appropriate. Provided that the cover outermost (or outer) layer has a Shore D hardness B and a cover layer disposed inside and contiguous to the cover outermost layer (the inside layer being the inner layer in the illustrated embodiment having a two-layer cover of inner and outer layers, or the inner layer in the other embodiment having a three-layer cover of innermost, inner and outer layers) has a Shore D hardness A, the invention requires that the product of these hardnesses, A×B, be in the range of 1,500 to 5,000. The product A×B is preferably in the range of 2,000 to 4,000, more preferably 2,500 to 4,000, and most preferably 3,000 to 4,000. A too small product A×B leads to too much spin whereas a too large product A×B leads to too less spin, both failing to attain the objects of the invention. Where the cover is of three-layer structure (innermost, inner and outer layers), it is preferred that the inner and outer layers have a Shore D hardness in the same range as above and the innermost layer has a Shore D hardness in the same range as the inner layer.

In enclosing the core with the cover of at least two layers, any desired molding method may be used. For example, injection molding or compression molding may be employed in a conventional manner.

No particular limits are imposed on the thickness of the cover inner and outer layers. Usually, the cover inner layer has a radial thickness or gage of 0.8 to 5.0 mm, and especially 1.0 to 3.0 mm; and the cover outer layer has a radial thickness or gage of 0.8 to 5.0 mm, and especially 1.0 to 4.0 mm.

Figure 2:
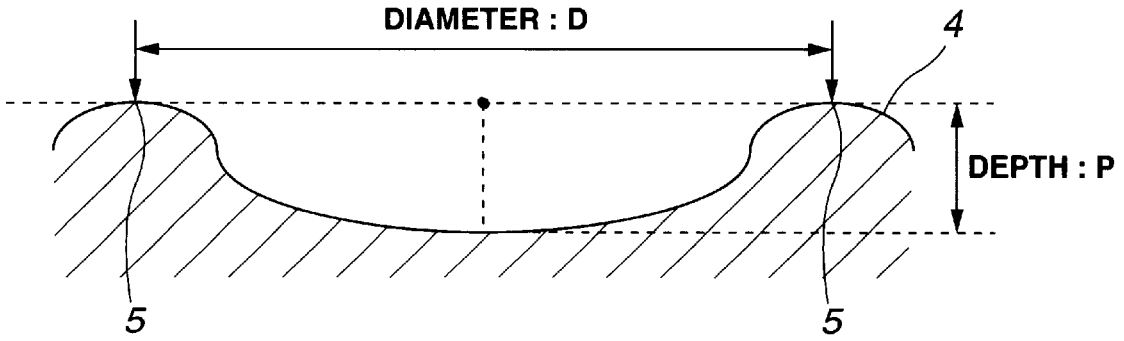
FIG. 2 is an enlarged cross-sectional view of one dimple in the ball surface.

In the golf ball of the invention, the cover outermost layer (which is the outer layer in the illustrated embodiment having a two-layer cover of inner and outer layers, or the outer layer in the other embodiment having a three-layer cover of innermost, inner and outer layers) is formed with a plurality of dimples. Typical dimples are circular in plane shape. As seen from the cross-sectional shape of FIG. 2, each dimple is a concave indentation having a bottom and a circular edge or top 5 where the dimple is connected to a land 4. Preferably the curvilinear line of the concave indentation is deformed near the edge to define a rounded edge portion as shown in FIG. 2.

The dimple has a diameter which is the distance D between the opposite edge points 5 (or the highest points) of the dimple where the dimple is joined to the land 4 (the ball surface where no dimple is formed). The dimple has a depth which is the vertical distance P from the center of an imaginary plane circumscribed by the dimple edge to the bottom (or deepest point) of the dimple. In most cases, the golf ball is surface coated with paint, wherein the diameter and depth of a dimple are those in the coated state.

The plurality of dimples include at least three types, preferably three to five types of dimples which are different in diameter and/or depth. The dimple diameter is preferably in the range of 2.0 to 5.0 mm, more preferably 2.5 to 4.5 mm and the dimple depth is preferably in the range of 0.09 to 0.17 mm, more preferably 0.1 to 0.165 mm. The ratio of the average diameter (AD) to the average depth (AP) of dimples is from 27/1 to 33/1, preferably from 27.1/1 to 32/1, more preferably from 27.3/1 to 31/1. An AD/AP ratio of less than 27 causes the ball to take a rather dropping trajectory near landing whereas an AD/AP ratio of more than 33 causes the ball to follow a ballooning trajectory, both leading to a reduced distance.

The average diameter (AD) of dimples used herein is represented by $(D_1+D_2+\ldots+D_n)/n$ (mm) when n types of dimples having different diameters $D_1, D_2, \ldots D_n$ (mm) are included. The average depth (AP) of dimples used herein is represented by $(P_1+P_2+\ldots+P_n)/n$ (mm) when n types of dimples having different depths $P_1, P_2, \ldots P_n$ (mm) are included. The average diameter (AD) and average depth (AP) are not related to the number of those dimples having the same diameter and depth.

The invention further requires that the overall dimple volume Vs be in the range of 260 to 340 $mm^3$, preferably 270 to 300 $mm^3$. The overall dimple volume Vs is the sum of the volumes of all dimple spaces each defined below a plane (depicted by broken lines in FIG. 2) circumscribed by the dimple edge. A too small value of Vs causes the ball to follow a rather ballooning trajectory whereas a too large value of Vs causes the ball to follow a nose-down trajectory and hence, a dropping trajectory.

In addition to the above-described dimple parameters, the proportion $V_R$ (%) of the overall dimple volume Vs divided by the volume of an imaginary sphere given on the assumption that no dimples are formed in the golf ball surface is preferably 0.5 to 1.1%, and more preferably 0.6 to 1.0%. The value $V_0$ of the volume of each dimple space defined below a plane circumscribed by the dimple edge divided by the volume of a cylinder whose bottom is that plane and whose height is the maximum depth of the dimple from the bottom preferably ranges from 0.35 to 0.7, more preferably from 0.38 to 0.65.

The total number of dimples is not critical although it is usually from 370 to 450, preferably from 370 to 440. The arrangement of dimples on the ball surface is not critical, and well-known regular octahedral and regular icosahedral arrangements are useful.

Preferably the golf ball as a whole has a hardness corresponding to a deflection of 2.3 to 4.0 mm, more preferably 2.4 to 3.8 mm under an applied load of 100 kg. In accordance with the Rules of Golf, the golf ball is formed to a diameter of not less than 42.67 mm and a weight of not greater than 45.93 grams.

There has been described a golf ball which satisfies the feel, durability and restitution requirements imposed on the ball structure and offers good flight characteristics, and thus has an advanced overall profile of performance.

EXAMPLE

Examples of the invention are given below by way of illustration and not by way of limitation.

Examples 1–6 & Comparative Examples 1–4

Core-forming rubber compositions of the formulation shown in Table 1 were worked in a kneader, molded in a mold and vulcanized at a temperature of 155° C. for about 15 minutes, forming cores designated (a) to (e). It is noted that core (e) was a center core, around which another composition of the formulation shown in Table 1 was injection molded to form a core outer layer, yielding a two-layer core.

Around each of the cores, cover stocks of the formulation shown in Table 2 were successively injection molded in the combination shown in Tables 4 and 5, forming a cover. Golf balls of Examples 1 to 6 and Comparative Examples 1 to 4 were manufactured in this way. On the surface of these golf balls, dimples of the types shown in Table 3 were formed during molding in the combination shown in Tables 4 and 5.

The cores and the golf balls were examined by the following tests. The results are also shown in Tables 4 and 5.

Core Hardness and Ball Hardness

The hardness of the core or ball is expressed by a deflection (mm) under an applied load of 100 kg.

Flight Performance

Using a swing robot of Miyamae K.K., the ball was actually hit at a head speed of 40 m/sec (HS40) with a driver (W#1, PRO 230 Titan, loft 10°, by Bridgestone Sports Co., Ltd.). Spin, carry, total distance, and trajectory were determined, on the basis of which flight performance was rated. With respect to the trajectory, twelve balls for each sample were actually hit and their trajectory was visually observed. With respect to the flight performance rating, the ball was rated "○" (good), "Δ" (average) or "x" (poor) by an overall examination based on all the data of spin, carry, total distance and trajectory.

Feel

Five amateur golfers with a head speed of about 40 nm/sec actually hit the balls and evaluated the feel according to the rating: "○" for very soft feel, "Δ" for average feel, and "x" for hard feel.

Durability

Using a swing robot of Miyamae K.K., the ball was repeatedly hit at a head speed of 45 m/sec (HS45) with a driver (W#1, PRO 230 Titan, loft 10°, by Bridgestone Sports Co., Ltd.). The ball surface was observed and evaluated according to the following criterion relative to the number of hits.

○: sound

Δ: relatively premature failure x: premature failure

Overall Evaluation

With all the test results taken together, the ball was evaluated " " for good, "Δ" for average, and "x" for poor.

In Tables 1 and 2, all the amounts of ingredients blended are parts by weight. The trade name "BR01" is cis-1,4-polybutadiene by Nippon Synthetic Rubber K.K.; "Hytrel" is the trade name of polyester elastomer by Dupont-Toray K.K.; "Surlyn" is the trade name of ionomer resins by E. I. duPont; and "Himilan" is the trade name of ionomer resins by Dupont-Mitsui Polychemical K.K.

TABLE 1

| | Core | | | | |
|---|---|---|---|---|---|
| | a | b | c | d | e |
| BR01 | 100 | 100 | 100 | 100 | 100 |
| Zinc diacrylate | 25.0 | 12.5 | 20.0 | 32.0 | 20.5 |
| Zinc oxide | 5.0 | 5.0 | 5.0 | 5.0 | 5.0 |
| Antioxidant | 0.2 | 0.2 | 0.2 | 0.2 | 0.2 |
| Barium sulfate | 31.6 | 36.7 | 33.7 | 29.2 | 35.0 |
| Dicumyl peroxide | 1.0 | 1.0 | 1.0 | 1.0 | 1.0 |
| Center core diameter (mm) | — | — | — | — | 33.7 |
| Hytrel 4767 | — | — | — | — | 100 |
| Core diameter (mm) | 36.40 | 36.40 | 36.40 | 36.40 | 36.40 |

Note:
Core (e) is a two-layer core.

TABLE 2

| | Cover stock | | | |
|---|---|---|---|---|
| | ① | ② | ③ | ④ |
| Surlyn 8120 | 60 | — | 50 | — |
| Himilan 1650 | 40 | — | 50 | 80 |
| Himilan 1557 | — | 50 | — | — |
| Himilan 1605 | — | 50 | — | — |
| Himilan 1706 | — | — | — | 20 |

Note:
Additionally, appropriate amounts of titanium dioxide and barium sulfate were blended.

TABLE 3

| Set | Diameter (mm) | Depth (mm) | Number of dimples | Total number of dimples | Average diameter AD (mm) | Average depth AP (mm) | AD/AP | Overall dimple volume ($mm^3$) |
|---|---|---|---|---|---|---|---|---|
| A | 4.100 | 0.135 | 60 | 372 | 3.733 | 0.133 | 28.1 | 274.5 |
| | 3.800 | 0.133 | 240 | | | | | |
| | 3.300 | 0.130 | 72 | | | | | |
| B | 4.000 | 0.130 | 62 | 432 | 3.550 | 0.128 | 27.8 | 279.4 |
| | 3.700 | 0.130 | 210 | | | | | |
| | 3.300 | 0.125 | 50 | | | | | |
| | 3.200 | 0.125 | 110 | | | | | |
| C | 4.100 | 0.135 | 132 | 432 | 3.650 | 0.133 | 27.5 | 324.6 |
| | 3.800 | 0.135 | 180 | | | | | |
| | 3.600 | 0.130 | 60 | | | | | |
| | 3.100 | 0.130 | 60 | | | | | |
| D | 4.100 | 0.120 | 60 | 372 | 3.733 | 0.120 | 31.1 | 297.3 |
| | 3.800 | 0.120 | 240 | | | | | |
| | 3.300 | 0.120 | 72 | | | | | |
| E | 4.150 | 0.110 | 54 | 360 | 3.833 | 0.110 | 34.8 | 287.9 |
| | 3.850 | 0.110 | 174 | | | | | |
| | 3.500 | 0.110 | 132 | | | | | |
| F | 4.200 | 0.155 | 50 | 314 | 3.650 | 0.153 | 23.9 | 278.2 |
| | 3.800 | 0.155 | 114 | | | | | |
| | 3.400 | 0.150 | 110 | | | | | |
| | 3.200 | 0.150 | 40 | | | | | |
| G | 4.200 | 0.135 | 50 | 314 | 3.650 | 0.135 | 27.0 | 267.8 |
| | 3.800 | 0.135 | 114 | | | | | |
| | 3.400 | 0.135 | 110 | | | | | |
| | 3.200 | 0.135 | 40 | | | | | |

TABLE 4

| | Example | | | | | |
|---|---|---|---|---|---|---|
| | 1 | 2 | 3 | 4 | 5 | 6 |
| Core | | | | | | |
| Type | a | b | c | c | c | e* |
| Hardness (mm) | 3.3 | 5.0 | 4.0 | 4.0 | 4.0 | 4.8 |
| Cover inner layer | | | | | | |
| Type | 1 | 2 | 3 | 1 | 1 | 1 |
| Gage (mm) | 1.65 | 1.65 | 1.65 | 1.65 | 1.65 | 1.65 |
| Hardness A (Shore D) | 56 | 60 | 58 | 56 | 56 | 56 |
| Cover outer layer | | | | | | |
| Type | 2 | 4 | 4 | 3 | 3 | 3 |
| Gage (mm) | 1.5 | 1.5 | 1.5 | 1.5 | 1.5 | 1.5 |
| Hardness B (Shore D) | 60 | 63 | 63 | 58 | 58 | 58 |
| Hardness product A × B | 3360 | 3780 | 3654 | 3248 | 3248 | 3248 |
| Dimples | | | | | | |
| Set | C | A | B | C | C | C |
| AD/AP | 27.5 | 28.1 | 27.8 | 27.5 | 27.5 | 27.5 |
| Overall volume ($mm^3$) | 324.6 | 274.5 | 279.4 | 324.6 | 324.6 | 324.6 |
| Ball | | | | | | |
| Hardness (mm) | 2.6 | 2.4 | 2.5 | 3.2 | 3.2 | 3.6 |
| Diameter (mm) | 42.7 | 42.7 | 42.7 | 42.7 | 42.7 | 42.7 |
| Weight (g) | 45.3 | 45.3 | 45.3 | 45.3 | 45.3 | 45.3 |
| Flight performance, W#1/HS40 | | | | | | |
| Spin (rpm) | 2430 | 2250 | 2325 | 2380 | 2375 | 2375 |
| Carry (m) | 186.0 | 185.5 | 186.5 | 186.5 | 185.0 | 185.0 |
| Total (m) | 199.5 | 200.5 | 199.0 | 200.1 | 198.8 | 198.8 |
| Trajectory | moderately low, boring trajectory | moderately high, boring trajectory | moderately low, boring trajectory | moderately low, boring trajectory | moderately low, boring trajectory | moderately low, boring trajectory |
| Rating | ○ | ○ | ○ | ○ | ○ | ○ |
| Feel, W#1 | ○ | ○ | ○ | ○ | ○ | ○ |
| Durability | ○ | ○ | ○ | ○ | ○ | ○ |
| Overall evaluation | ○ | ○ | ○ | ○ | ○ | ○ |

Note: core (e) is a two-layer core.

TABLE 5

| | | Comparative Example | | | |
|---|---|---|---|---|---|
| | | 1 | 2 | 3 | 4 |
| Core | Type | d | a | a | d |
| | Hardness (mm) | 2.5 | 3.3 | 3.3 | 2.5 |
| Cover inner layer | Type | ② | ① | ① | ① |
| | Gage (mm) | 1.65 | 1.65 | 1.65 | 1.65 |
| | Hardness A (Shore D) | 60 | 56 | 56 | 56 |
| Cover outer layer | Type | ④ | ② | ② | ② |
| | Gage (mm) | 1.5 | 1.5 | 1.5 | 1.5 |
| | Hardness B (Shore D) | 63 | 60 | 60 | 60 |
| Hardness | product A × B | 3780 | 3360 | 3360 | 3360 |
| Dimples | Set | D | E | F | G |
| | AD/AP | 31.1 | 34.8 | 23.9 | 27.0 |
| | Overall volume ($mm^3$) | 297.3 | 287.9 | 278.2 | 267.8 |
| Ball | Hardness (mm) | 2.0 | 2.6 | 2.2 | 2.2 |
| | Diameter (mm) | 42.7 | 42.7 | 42.7 | 42.7 |
| | Weight (g) | 45.3 | 45.3 | 45.3 | 45.3 |
| Flight performance, W#1/HS40 | Spin (rpm) | 2450 | 2433 | 2430 | 2458 |
| | Carry (m) | 179.5 | 182.0 | 184.7 | 185.5 |
| | Total (m) | 188.5 | 187.5 | 195.5 | 197.0 |
| | Trajectory | ballooning trajectory | ballooning trajectory | slightly nose-down | slightly nose-down |
| | Rating | x | x | Δ | Δ |
| Feel, W#1 | | x | ○ | ○ | ○ |
| Durability | | ○ | ○ | ○ | ○ |
| Overall evaluation | | x | x | Δ | Δ |

As is evident from Tables 4 and 5, the golf balls of Comparative Examples 1 to 4 are inferior in overall evaluation to the inventive golf balls of Examples 1 to 6. More specifically, the ball of Comparative Example 1 shows a poor feel, relatively high spin rate, rather ballooning trajectory, and shorter distance because the core is too hard and the ball structure is not optimized. The ball of Comparative Example 2 shows a ballooning trajectory and shorter distance because the AD/AP ratio of dimples is as high as 34.8. The ball of Comparative Example 3, which corresponds to JP-A 10-248955, shows a slightly nose-down trajectory and shorter distance because the AD/AP ratio of dimples is as low as 23.9. The ball of Comparative Example 4 shows a relatively high spin rate, slightly nose-down trajectory and somewhat shorter distance because the core is too hard.

In contrast, the golf balls of Examples 1 to 6 are superior in all of flight performance, feel and durability.

Japanese Patent Application No. 11-028769 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

What is claimed is:

1. A golf ball comprising a core and a cover of at least two layers around the core, the cover layers including the outermost layer which is formed with a plurality of dimples, wherein said core has a hardness corresponding to a deflection of 3.0 to 6.0 mm under a load of 100 kg, said cover outermost layer has a Shore D hardness of 58 to 70, the product (A×B) of the Shore D hardness, represented by B, of said cover outermost layer multiplied by the Shore D hardness, represented by A, of a cover layer disposed inside and contiguous to said cover outermost layer is in the range of 1,500 to 5,000, the plurality of dimples include at least three types of dimples which are different in diameter or depth or both and have an average diameter (AD) and an average depth (AP) wherein the ratio (AD/AP) of the average diameter to the average depth is from 27/1 to 33/1, and the overall dimple volume which is the sum of the volumes of all dimple spaces each defined below a plane circumscribed by a dimple edge is in the range of 260 to 340 $mm^3$.

2. The golf ball of claim 1 wherein said core is formed of a rubber composition based on cis-1,4-polybutadiene.

3. The golf ball of claim 1 which has a hardness corresponding to a deflection of 2.3 to 4.0 mm under a load of 100 kg.

4. The golf ball of claim 1 wherein the total number of dimples is 370 to 450.

5. The golf ball of claim 1, wherein the product (A×B) is in the range of 2,000 to 4,000.

6. The golf ball of claim 1, wherein the product (A×B) is in the range of 2,500 to 4,000.

7. The golf ball of claim 1, wherein the product (A×B) is in the range of 3,000 to 4,000.

8. The golf ball of claim 1, wherein the outermost layer of the cover has a Shore D hardness of 58 to 65.

9. The golf ball of claim 1, wherein the outermost layer of the cover has a shore D hardness of 58 to 63.

10. The golf ball of claim 1, wherein the cover layer disposed inside and contiguous to the cover outermost layer has a Shore D hardness of 30 to 70.

11. The golf ball of claim 1, wherein the cover layer disposed inside and contiguous to the cover outermost layer has a Shore D hardness of 35 to 68.

12. The golf ball of claim 1, wherein the core has a hardness corresponding to a deflection of 3.3 to 6.0 mm under a load of 100 kg.

13. The golf ball of claim 1, wherein the core has a hardness corresponding to a deflection of 4.0 to 6.0 mm under a load of 100 kg.

14. The golf ball of claim 1, wherein the ratio (AD/AP) of the average diameter to the average depth is from 27.1/1 to 32/1.

15. The golf ball of claim 1, wherein the ratio (AD/AP) of the average diameter to the average depth is from 27. 3/1 to 31/1.

16. The golf ball of claim 1, wherein the overall dimple volume is in the range of 270 to 300 $mm^3$.

17. The golf ball of claim 1, which is consisting of a core of one layer and a cover of two layers.

18. The golf ball of claim 1, which is consisting of a core of two layers and a cover of two layers.

* * * * *